US012466033B2

(12) United States Patent
Velesig et al.

(10) Patent No.: US 12,466,033 B2
(45) Date of Patent: Nov. 11, 2025

(54) HONING BRUSH LENGTH ADJUSTMENT

(71) Applicant: Kennametal Inc., Latrobe, PA (US)

(72) Inventors: Joseph Velesig, West Lebanon, PA (US); Norm DiMatteo, Blairsville, PA (US); Joshua Singley, Latrobe, PA (US)

(73) Assignee: KENNAMETAL INC., Latrobe, PA (US)

( * ) Notice: Subject to any disclaimer, the term of this patent is extended or adjusted under 35 U.S.C. 154(b) by 440 days.

(21) Appl. No.: 18/052,670

(22) Filed: Nov. 4, 2022

(65) Prior Publication Data

US 2024/0149399 A1 May 9, 2024

(51) Int. Cl.

| | |
|---|---|
| ***B24D 13/14*** | (2006.01) |
| ***A46B 13/00*** | (2006.01) |
| ***A46B 13/02*** | (2006.01) |
| ***B24D 11/02*** | (2006.01) |

(52) U.S. Cl.

CPC ..... *B24D 13/145* (2013.01); *A46B 13/003* (2013.01); *A46B 13/008* (2013.01); *A46B 13/02* (2013.01); *B24D 11/02* (2013.01); *A46B 2200/3086* (2013.01)

(58) Field of Classification Search

CPC ..... B24B 29/005; B24D 13/145; B24D 9/08; A46B 13/003; A46B 13/008; A46B 13/02; A46B 2200/3086; A46B 2200/3093; A46D 1/0261; A46D 1/02; A46D 1/023

USPC ..... 15/180

See application file for complete search history.

(56) References Cited

U.S. PATENT DOCUMENTS

| | | | |
|---|---|---|---|
| 3,384,915 | A | 5/1968 | Rands |
| 9,776,305 | B2 | 10/2017 | Palushaj |
| 2008/0160886 | A1 | 7/2008 | Palushaj |

FOREIGN PATENT DOCUMENTS

| | | | | |
|---|---|---|---|---|
| JP | 2013141731 A | * | 7/2013 | ..... B24B 29/005 |
| WO | 2019138324 A1 | | 7/2019 | |

OTHER PUBLICATIONS

Extended European Search Report for European Application No. 23204200.2, mailed Mar. 15, 2024, 8 Pages.

* cited by examiner

*Primary Examiner* — Monica S Carter
*Assistant Examiner* — Sharonda T Felton
(74) *Attorney, Agent, or Firm* — Christopher J. Owens

(57) ABSTRACT

A modified honing brush is provided comprising one or more bristles and one or a plurality of reusable stackable plates having one or more holes or voids located in the plates, or one or more support guides, and wherein each of the bristles is independently fitted through one or more of the holes or voids of the plates or surrounded by one or more support guides.

27 Claims, 12 Drawing Sheets

HONING BRUSH LENGTH ADJUSTMENT

CROSS-REFERENCE TO RELATED APPLICATION

Not applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a modified honing brush having one or more bristles and one or a plurality of reusable plate(s) or support guide(s) having varying thicknesses with varying holes or voids located in the plates or support guides. The reusable plate(s) or support guide(s) are attached to or placed in juxtaposition to the base of one or more bristles or tufts of bristles of the honing brush. These plate(s) or support guide(s) stiffen the bristles and make the brushes' bristles effective length shorter.

2. Description of the Background Art

The background art discloses honing brushes that are useful for a variety of applications including to improve the surface finish of, for example but not limited to a cutting tool, or a bore of a cylinder. Honing brushes are generally known to have abrasive bristles or bristles made of flexible filaments, for example, nylon.

One use of a honing brush is as a surface finishing tool. The honing brush is applied to a work surface to reduce the rough peaks of a work surfaces micro-structure. Typically, a small amount of material is removed from a work pieces surface. The work piece may be for example, but not limited to, a cutting edge of a cutting insert. For example, but not limited to, a honing brush application of from ten to fifty strokes or revolutions upon a surface of a work piece may remove for example but not limited to 0.0001 inch of material from the surface of the work piece. The bristles of a honing brush may be made of, for example but not limited to, abrasive material such as aluminum oxide or silicon carbide, and have a bristle shaft length from about 5 to 30 millimeters, or from about 5 inches to 15 inches, and have a grit ranging from about 80 to 320 to up to and including 1000, and a bristle stem diameter of from greater than or equal to about 0.01 inch, and in certain instances from about 0.1 inch to about 0.3 inch.

Another known use of a honing brush is as a deburring tool, or for edge blending.

It is well known that use of a honing brush causes wear of the bristles of the honing brush. Honing brush performance changes as the bristles of the brushes wear over time and the bristles become shorter. Longer bristled brushes have been tested, but are often not stiff enough at the initial length. Having inadequate stiffness is problematic in the use of a honing brush.

This invention addresses the above disadvantages of the background art by incorporating one or more reusable plates or guides to a honing brush.

SUMMARY OF THE INVENTION

A modified honing brush is provided having one or more bristles and one or a plurality of reusable plates or guides (i.e. support guides) having varying thicknesses with varying holes or voids located in the plates or guides. These reusable plate(s) or guide(s) are attached to or placed in juxtaposition to the base of one or more bristles or the base of tufts of bristles of the honing brush. These plate(s) or guide(s) stiffen the bristles and make the brushes bristle effective length shorter. As the bristles of the honing brush of the present invention wear in operation upon a work piece, the reusable plates or guides are independently removable in sequence to keep the effective bristle brushing length constant overtime. The present invention enhances the useful life of a honing brush. The modified honing brush of this invention having the reusable and removable plate(s) or guide(s) is a novel feature of this invention.

These and other embodiments of this invention shall be described in more detail herein and in the drawings that show certain embodiments of this invention.

BRIEF DESCRIPTION OF THE DRAWINGS

While various embodiments of this invention are illustrated in the drawings, the particular embodiments shown should not be construed to limit the claims. Various modifications and changes may be made without departing from the scope of the invention.

DETAILED DESCRIPTION OF THE INVENTION

Figure 1:
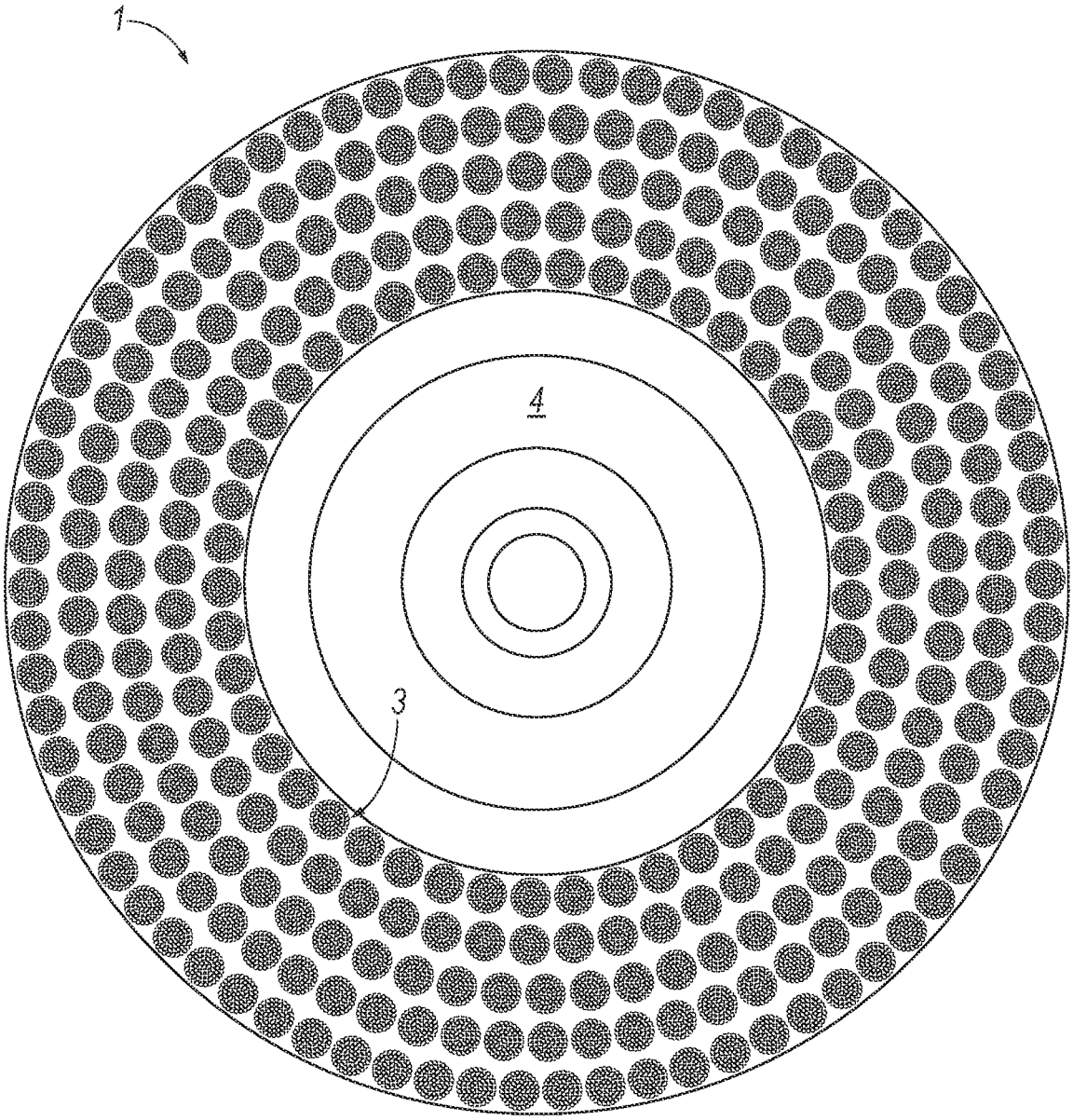
FIG. 1 shows a top view of a background and known in the art honing brush.
Figure 2A:
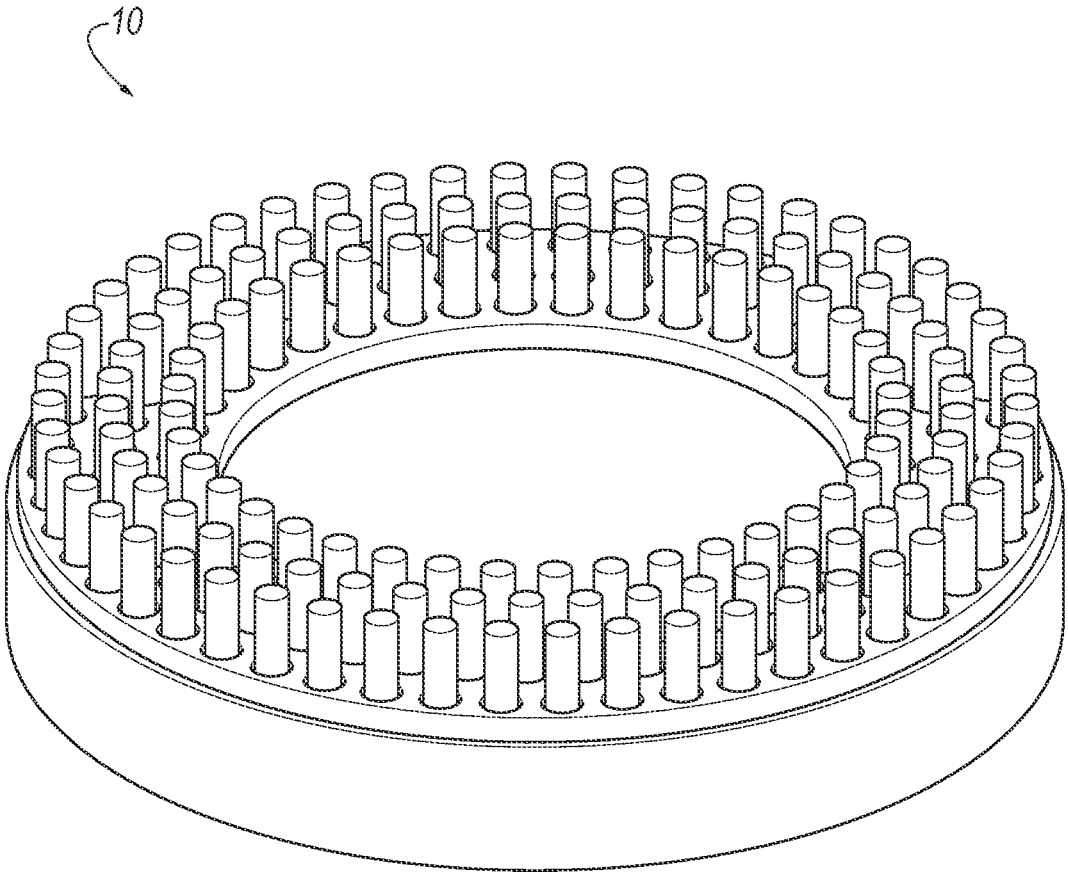
FIG. 2A shows an isometric view of a certain embodiment of the modified honing brush of this invention.
Figure 2B:
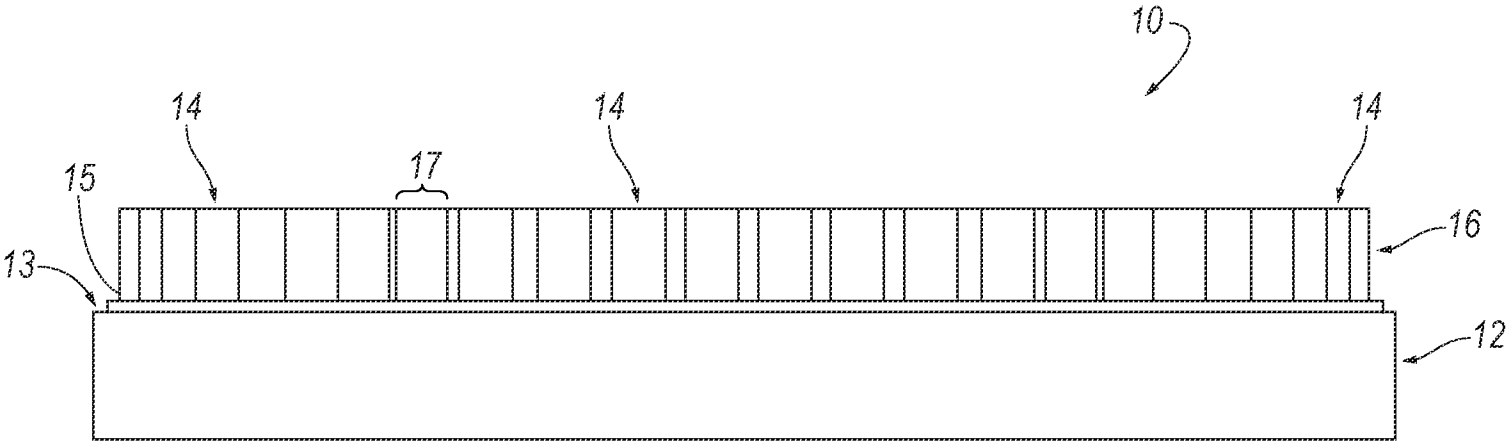
FIG. 2B shows a side cross sectional view of the modified honing brush of this invention.
Figure 2C:
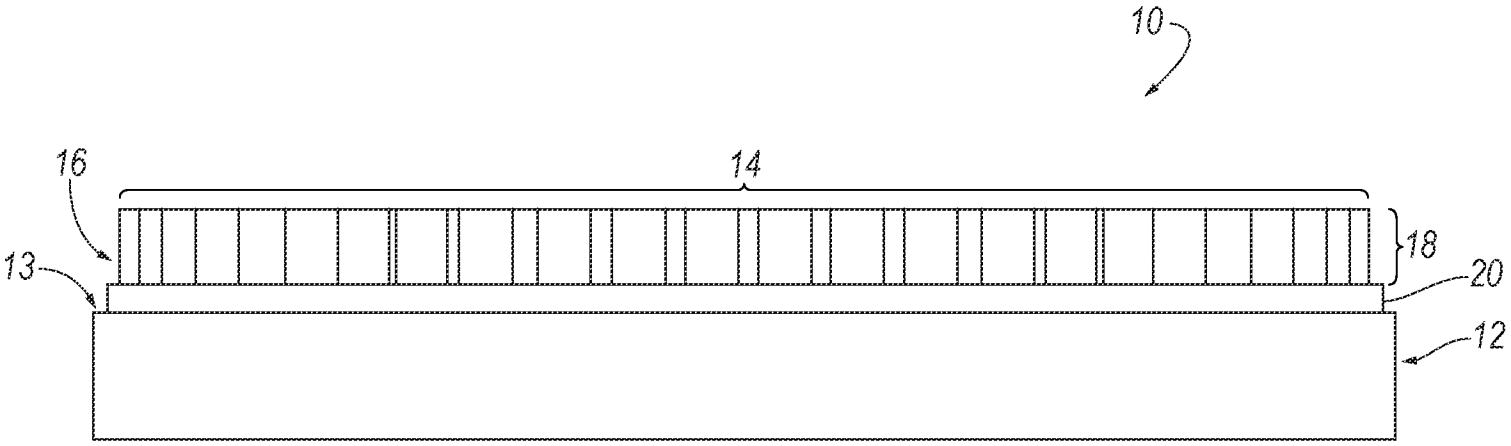
FIG. 2C shows a side cross sectional view of the modified honing brush of this invention.
Figure 3A:
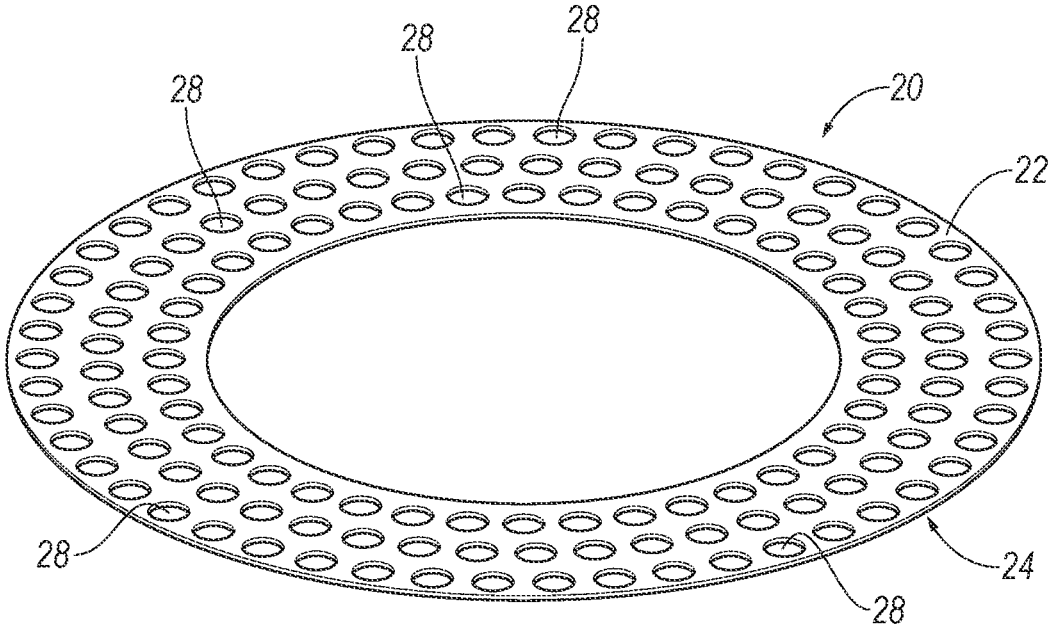
FIG. 3A shows an isometric view of a plate of this invention.
Figure 3B:
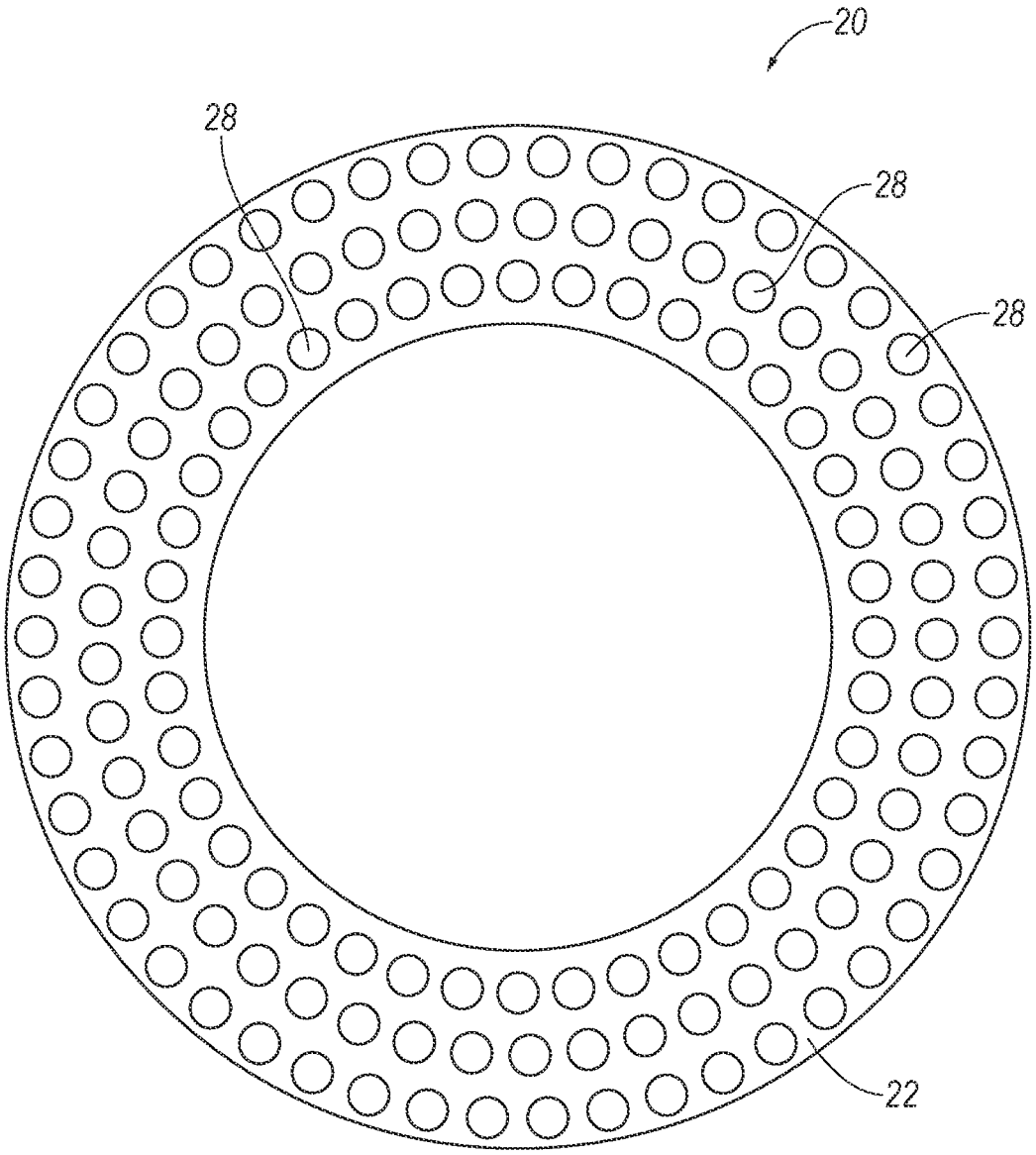
FIG. 3B shows a top view of a plate of this invention.

Referring to FIGS. 2A, 2B, 2C, 3A, 3B, 4A, 4B, and 5, certain embodiments of a modified honing brush (10) of this invention is provided having one or more bristles (14) and one reusable plate (20) or a plurality (i.e. two or more) of reusable plates (20, 30, and 40) or support guides (i.e. guides) (50, 52, 54, 56, and/or 58) having varying thicknesses, with each of said plates (20, 30, and 40) having one or more varying holes (28, 38, and 48, respectively) or voids (28, 38, and 48, respectively) located in the plates (20, 30, and 40, respectively). These reusable plate(s) (20, 30, and 40, respectively) or support guide(s) (50, 52, 54, 56, and/or 56) are attached to or placed in juxtaposition to the base (13) of the bristle (14) or tuft of bristles (17) of the honing brush (10). These plate(s) (20, 30, and 40, respectively) or support guide(s) (50, 52, 54, 56, and/or 56) surround the bristles (14) or tufts of bristles (17) and stiffen the bristles (14) or tufts of bristles (17) and make the honing brushes' (10) bristle (14) or tuft of bristles (17) effective length shorter. As the bristles (14) of the honing brush of the present invention wear in operation upon a work piece, one or more of the reusable plates (20, 30, and 40, respectively) or support guides (50, 52, 54, 56, and/or 58) are independently removable in sequence to keep the effective bristle (14) brushing length constant overtime. The present invention enhances the useful life of a honing brush. The background known honing brush have bristles that are glued or crimped into a honing brush and the length of the bristles are not adjustable. The modified honing brush (10) of this invention having one or more of the reusable and removable plate(s) (20, 30, and 40, respectively) or support guide(s) (50, 52, 54, 56, and/or 58) is/are a novel feature(s) of this invention.

Brushes wear over time and become shorter and stiffer. FIG. 1 shows a typical known in the art honing brush (1) having rows of bristles (3) attached to a brush hub (4). More specifically, FIG. 1 shows a typical known in the art honing brush having concentric rows of bristles (3) attached to a brush hub (4).

Figure 4A:
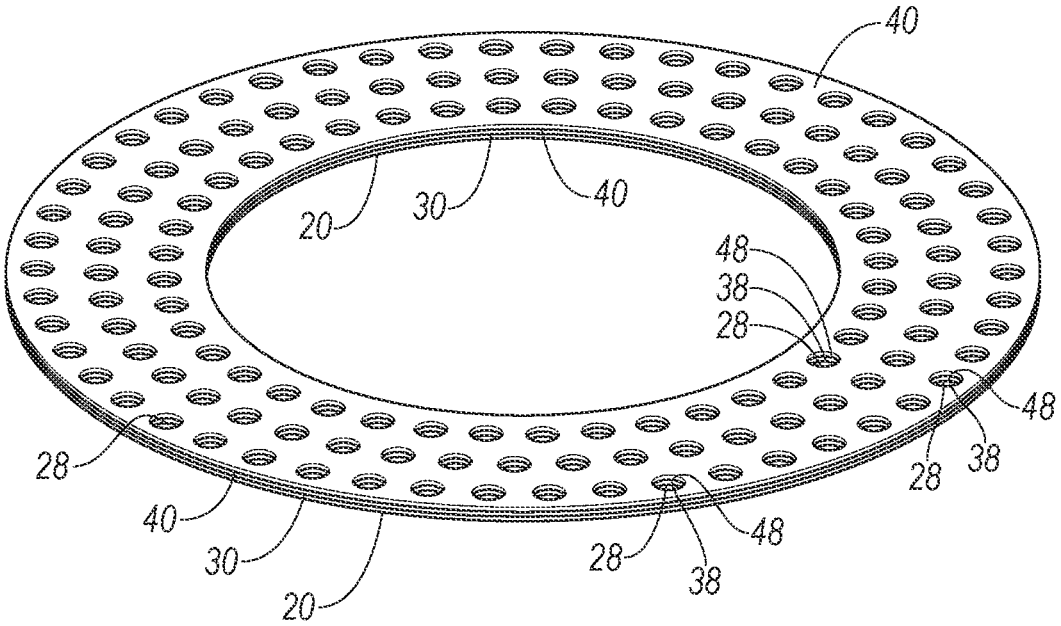
FIG. 4A shows an isometric view of the stackable arrangement of a plurality of plates (three plates shown stacked together) of the honing brush of this invention.
Figure 4B:
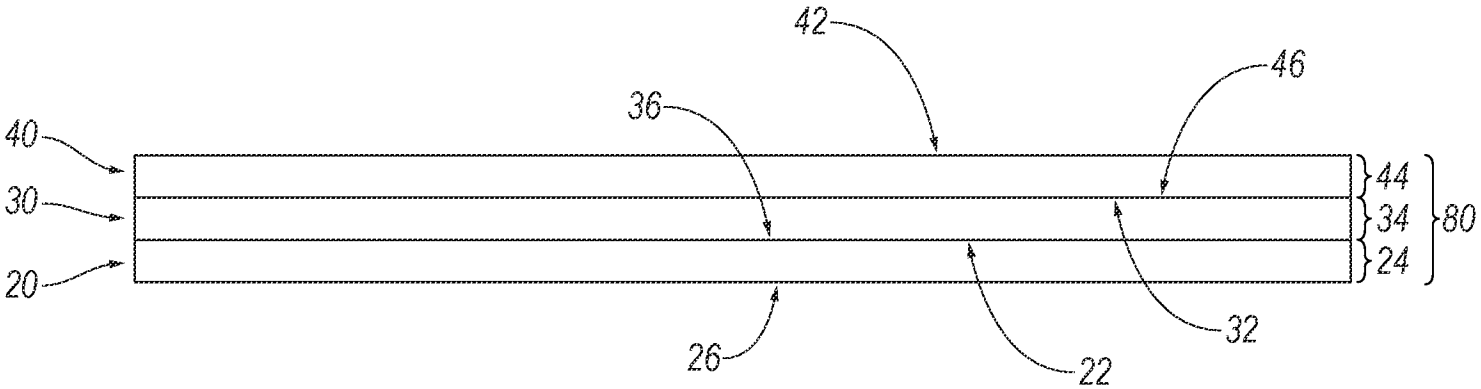
FIG. 4B shows a side cross sectional view of the stackable arrangement of a plurality of plates (three plates shown stacked together) of the honing brush of this invention.
Figure 5:
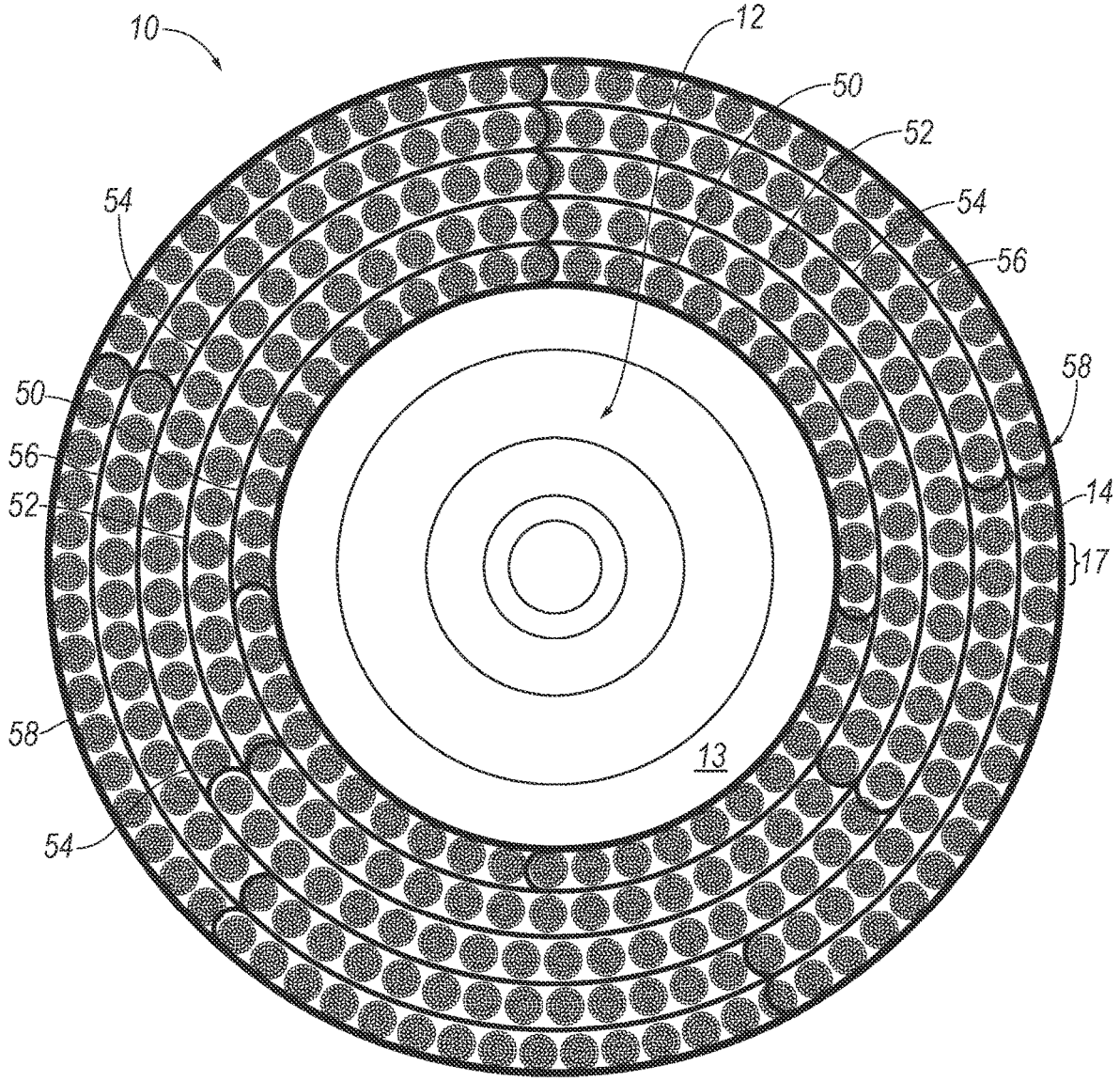
FIG. 5 shows a top cross sectional view of the support guides of this invention.
Figure 6A:
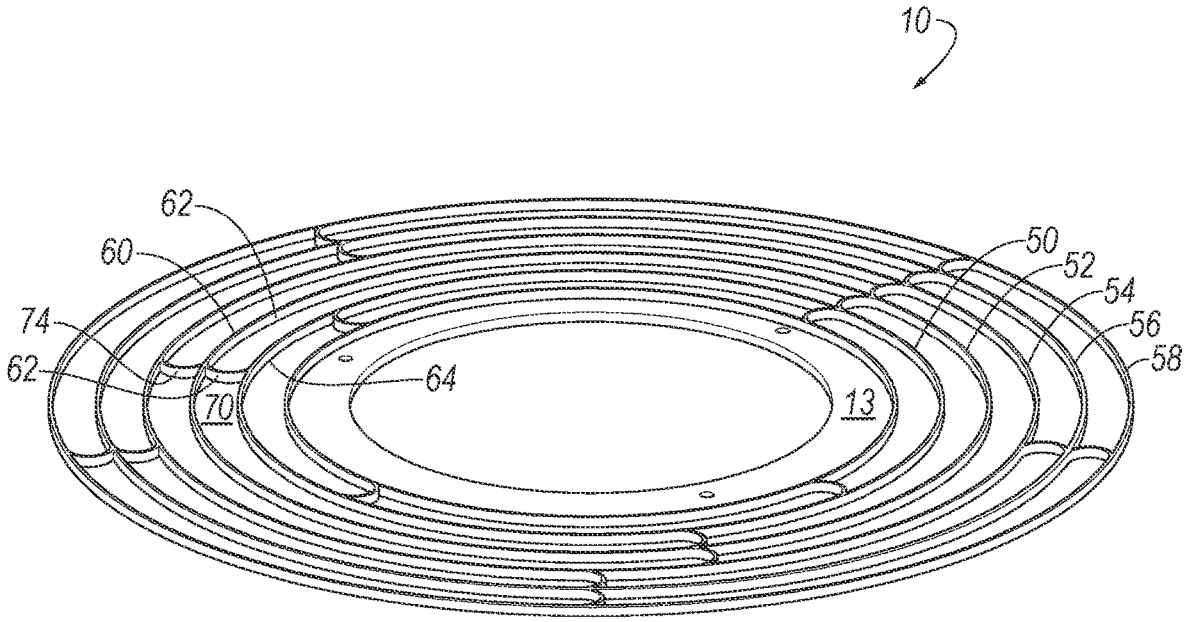
FIG. 6A shows an isometric view of the support guide of this invention.
Figure 6B:
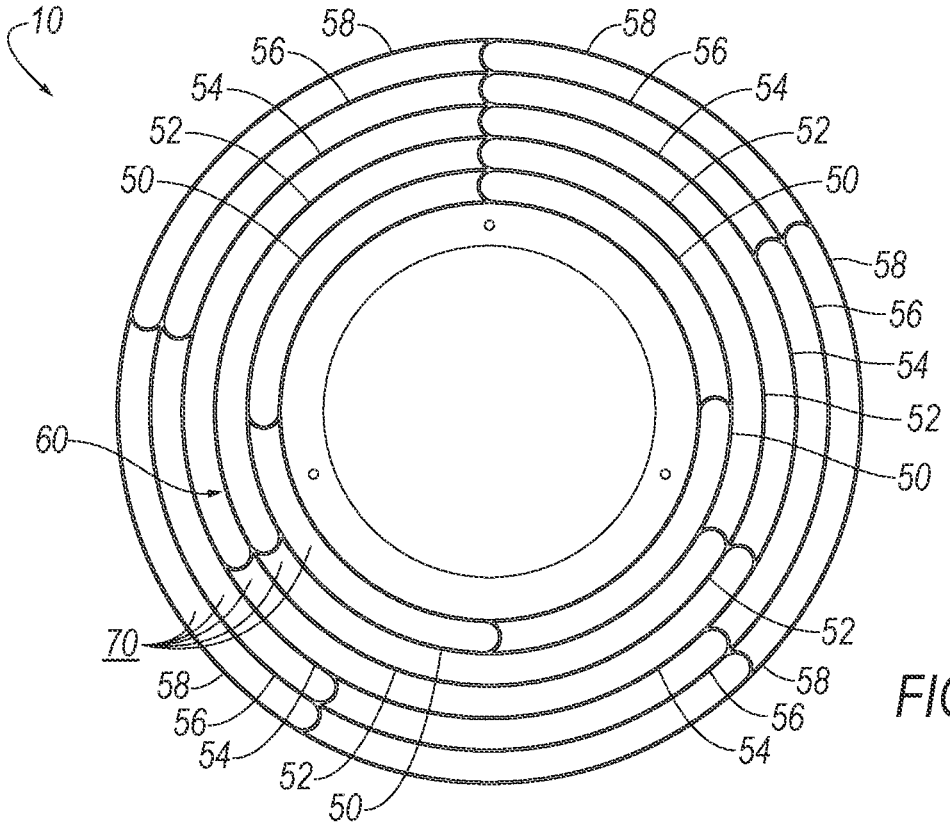
FIG. 6B shows a top view of the support guides of this invention.
Figure 6C:
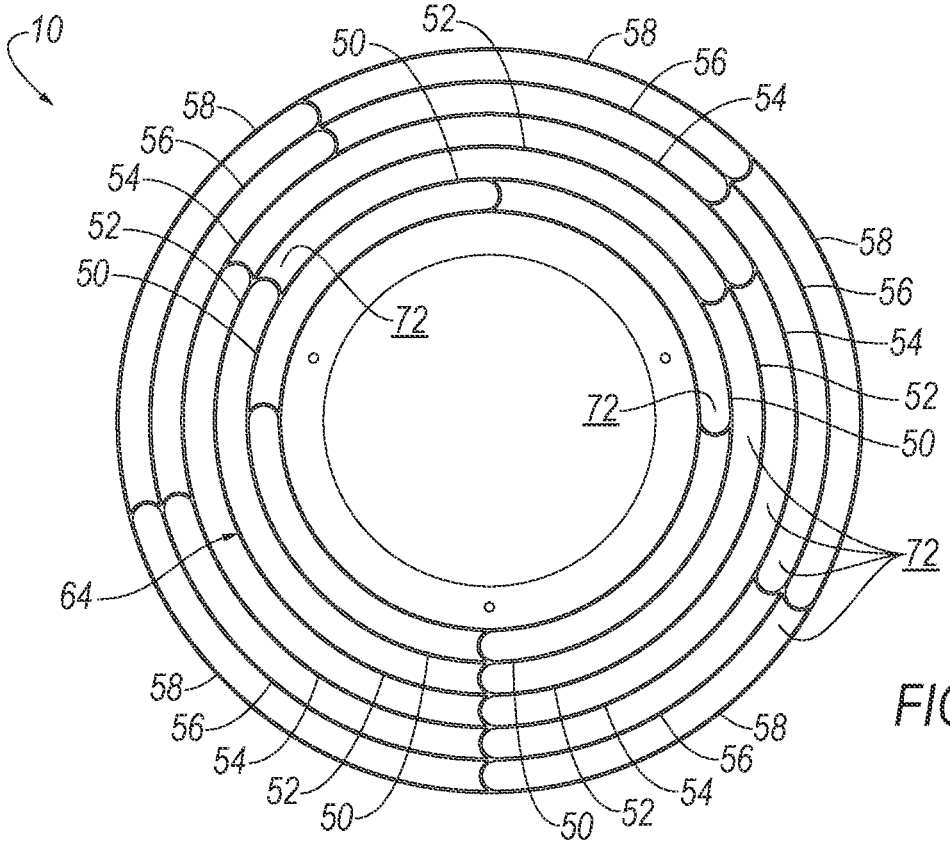
FIG. 6C shows a bottom view of the support guides of this invention.
Figure 6D:
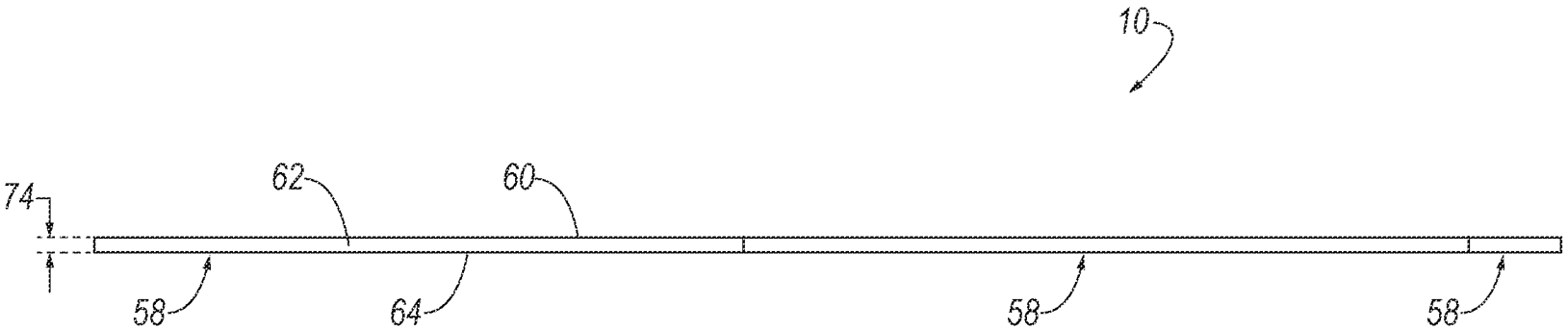
FIG. 6D shows a side view of the support guides of this invention.

Referring to FIGS. 4A, 4B, and 5, certain embodiments of the modified honing brush of this invention are provided, wherein one or more of the removable and stackable plates (20, 30, and 40, respectively) (FIGS. 4A and 4B) of this invention and the support guide (50, 52, 54, 56, and/or 58) (FIG. 5) of this invention make the bristles of the honing brush stiffer and effectively shorten the usable physical length of the bristle or tuft of bristles at the beginning of life of the honing brush. The reusable and stacked plate or plates or support guides provide multiple plate thicknesses around the base of the bristle or tuft of bristles and allow for adjustability of the useful shaft length of the bristle. As brushes wear, one or more plates or support guides are removed to keep effective brush length continuous. It will be understood by those persons of ordinary skill in the art that the plate(s) (20, 30, and 40, respectively) or support guide(s) (50, 52, 54, 56, and 58) of this invention are length adjustment elements relative to the bristle shaft length.

The removable plate(s) or guides(s) of this invention may be made of a metallic material, a non-metallic material, a plastic material, such as for example but not limited to an ABS plastic (acrylonitrile butadiene styrene thermoplastic polymer), a polyurethane thermoplastic polymer, or other thermoplastic polymer blends, such as for example but not limited to, a methyl methacrylate ABS, or any flexible material.

In certain embodiments of this invention the plate(s) are planar, and in certain other embodiments of this invention the plate(s) are conical. In certain embodiments of this invention, a single plate or support guide has a vertical thickness (height) of from about 1 millimeter to about 4 millimeters. The plates may be stacked one plate upon each other in any number of plates, such as for example, stacking of two or more plates upon each other. FIG. 4A and FIG. 4B show an example of this invention wherein three plates of this invention are stacked upon each other (20, 30, and 40). As the bristles of the honing brush wear, one or more plates may be removed to expose more of the length of the shafts of the bristles.

Referring to FIGS. 2A, 2B, 2C, 3A, 3B, 4A, and 4B, certain embodiments of the honing brush (10) of this invention are provided comprising a brush hub (12) having a face (13) wherein said face (13) of said brush hub (12) has at least one or a plurality of at least one or more outwardly projecting bristles (14), wherein each of said bristles(14) has a shaft (16) having a length (18); and a first plate (20) having a first side (22), a middle section (24), and a second side (26), wherein said middle section (24) of said first plate (20) is disposed between said first side (22) of said first plate (20) and said second side (26) of said first plate (20), and wherein said first side (22) of said first plate (20) is opposite to said second side (26) of said first plate (20), and wherein one or more holes (28) or voids (28) are located within said first plate (20), and wherein the one or more of said holes (28) or voids (28) extend from said first side (22) of said first plate (20), through said middle section (24) of said first plate (20) and through said second side (26) of said first plate (20), and wherein said shaft (16) of said bristle (14) is fitted through said hole (28) or void (28) of said first plate (20), and wherein said second side (26) of said first plate (20) is in juxtaposition to said face (13) of said brush hub (12) and wherein at least a portion of said middle section (24) of said first plate (20) is in juxtaposition to the base (15) of the bristle (14). In certain embodiments of this invention, the middle section (24) of said first plate (12) has a thickness of from about 1 millimeter to about ten millimeters. The shaft (16) of said bristle (14) is positioned generally perpendicularly to the face (13) of the brush hub (12). In certain embodiments of this invention, the shaft (16) of the bristle (14) has a length (18) from about 5 millimeters to about 30 millimeters.

The modified honing brush of this invention has a bristle that is made of an abrasive material or coated with an abrasive material, a non-metallic material, a plastic material, a polyurethane material, or a flexible material.

In certain embodiments of this invention, the modified honing brush has bristles arranged in a homogenous array or arranged in one or more concentric circles, attached and positioned on or partially within said brush hub.

In certain embodiments of this invention, the modified honing brush (10) has a plurality of bristles (14) that are formed in a tufted bristle arrangement. Preferably, the honing brush (10) of this invention has a brush hub (12) has a plurality of tufted bristle (17) arrangements. The modified honing brush (10) has one or more of the tufted bristle (17) arrangements that are independently fitted through one or more of said holes (28) or voids (28) of said first plate (20).

Referring to FIG. 4A and FIG. 4B, in certain embodiments of this invention, the modified honing brush (10), as described herein, further includes a second plate (30) having a first side (32), a middle section (34), and a second side (36), wherein said middle section (34) of said second plate (30) is disposed between said first side (32) of said second plate (30) and said second side (36) of said second plate (30), and wherein said first side (32) of said second plate (30) is opposite to said second side (36) of said second plate (30), and wherein one or more holes (38) or voids (38) are located within said second plate (30) wherein one or more of said holes (38) or voids (38) extend from said first side (32) of said second plate (30), through said middle section (34) of said second plate (30) and through said second side (36) of said second plate (30), and wherein said bristle (14) is fitted through said hole (38) or void (38) of said second plate (30). The middle section (34) of said second plate (30) has a thickness of from about 1 millimeter to about ten millimeters. The second plate (30) is stacked upon said first plate (20) such that said holes or voids (38) of said second plate (30) are aligned with said holes (28) or voids (28) of said first plate (20), and wherein said second plate (30) is independently removable from said first plate (20), and wherein said bristle (14) is fitted through said hole (38) or void (38) of said second plate (30) and through the hole (28) or void (28) of the first plate (20).

Referring to FIG. 4A and FIG. 4B, in certain embodiments of this invention, the modified honing brush (10), as described herein, further includes a third plate (40) having a first side (42), a middle section (44), and a second side (46), wherein said middle section (44) of said third plate (40) is disposed between said first side (42) of said third plate (40) and said second side (46) of said third plate (40), and wherein said first side (42) of said third plate (40) is opposite to said second side (46) of said third plate (40), and wherein one or more holes (48) or voids (48) are located within said third plate (34) wherein one or more of said holes (48) or voids (48) extend from said first side (42) of said third plate (40), through said middle section (44) of said third plate (40) and through said second side (46) of said third plate (40), and wherein said bristle (14) is fitted through said hole (48) or void (48) of said third plate (40). In certain embodiments of this invention, the middle section (44) of said third plate (40) has a thickness of from about 1 millimeter to about ten millimeters. The third plate (40) is stacked upon said second plate (30) and wherein said second plate (30) is stacked upon said first plate(20) such that said holes (48) or voids (48) of the third plate (40) and the holes (38) or voids (38) of the second plate (30), are aligned with said holes (28) or voids (28) of said first plate (20), and wherein said third plate (40) and said second plate (30) are each independently removable from said first plate (20), and wherein said bristle (14) is fitted through said hole (48) or void (48) of the third plate (4), through said hole (38) or void (38) of said second plate (30), and said hole (28) or void (28) of the first plate (20).

Thus, those persons of ordinary skill in the art will understand that FIG. 4A and FIG. 4B, in certain embodiments of this invention, the honing brush (10) has a plurality of said plates (20, 30, and 40), wherein each of said plates (20, 30, and 40, respectively) of are stackable upon each other to form a stack (80) of two or more of said plates (20, 30, and 40, respectively), and wherein said holes (28, 38, and 48) or said voids (28, 38, and 48) of each of said plates (20, 30, and 40, respectively) are in alignment such that said bristle (14) is fitted through said holes (28, 38, and 48) or voids (28, 38, and 48) of each of said plates (20, 30, and 40, respectively). Each plate (20, 30, and 40, respectively) is independently removable from said stack (80) of said plates (20, 30, and 40, respectively). It will be understood that the first plate (20) is the nearest (closest in proximity) in juxtaposition to the base (15) of the bristle (14) or of the tufted bristle (17) arrangement.

In certain embodiments of this invention, and referring to FIGS. 5 and 6A, 6B, 6C, and 6D, a modified honing brush (10) is provided having a brush hub (12) having a face (13) wherein said face (13) of said brush hub (12) has at least one or a plurality of at least one or more outwardly projecting bristles (14), wherein each of said bristles (14) has a shaft (16) (not shown) having a length (18) (not shown); and a support guide (50) or a plurality of support guides (50, 52, 54, 56, and 58, respectively), each of said support guides (50, 52, 54, 56, and 58, respectively) having a first side (60), a middle section (62), and a second side (64), wherein said middle section (62) of said support guide (50, 52, 54, 56, and 58, respectively) is disposed between said first side (60) of said support guide (50, 52, 54, 56, and 58, respectively) and said second side (64) of said support guide (50, 52, 54, 56, and 58, respectively), and wherein said first side (60) of said support guide (50, 52, 54, and 56, respectively) is opposite to said second side (64) of said support guide (50, 52, 54, 56, and 58, respectively), and wherein said middle section (62) of said support guide (50, 52, 54, 56, and 58, respectively) has a top open end (70) and a bottom open end (72), and wherein said top open end (70) of each of said support guide (50, 52, 54, 56, and 58, respectively) is opposite to said bottom open end (72) of said support guide (50, 52, 54, 56, and 58, respectively), and wherein said shaft (16) of said bristle (14) is fitted through said bottom open end (72) of said support guide (50, 52, 54, 56, and 58, respectively) and extends through said top open end (70) of said support guide (50, 52, 54, 56, and 58, respectively), and wherein each of said bottom open end (72) of said support guide (50, 52, 54, 56, and 58, respectively) is in juxtaposition to said face (13) of said brush hub (12). The middle section (62) of each of said support guide (50, 52, 54, 56, and 58, respectively) has a vertical height (74) that is perpendicular to said face (13) of said brush hub (12) wherein said vertical height (74) is for example but not limited to from about 1 millimeter to about ten millimeters. The shaft (16) of said bristle (14) is positioned generally perpendicular to the face (13) of the brush hub (12). In certain embodiments of this invention, the shaft (16) of the bristle (14) has a length from about 5 millimeters to about 30 millimeters. The bristle (14) is made of an abrasive material or coated with an abrasive material, a non-metallic material, a plastic material, a polyurethane material, or a flexible material. In certain embodiments of this invention, the bristles (14) are arranged in a homogenous array or in one or more concentric circles, positioned on and attached to said brush hub (12) or attached partially within said brush hub (12), and wherein said support guide (50, 52, 54, 56, and 58, respectively) is in the shape of a partial or complete concentric circle. In certain embodiments of this invention, the plurality of bristles (14) are formed in a tufted bristle (17) arrangement. In certain embodiments of this invention, the brush hub (14) has a plurality of tufted bristle (17) arrangements. In certain embodiments of this invention, one or more of said tufted bristle (17) arrangements are independently fitted through said middle section (62) of said support guide (50, 52, 54, 56, and 58, respectively). In a preferred embodiment of this invention, the honing brush has a plurality of said support guides (50, 52, 54, 56, and 58, respectively).

Table 1 shows how the theoretical deflection of a bristle changes as the length changes. The honing brush of the present invention having the plate(s) or support guide(s) positioned around the base of the bristle positioned on the brush hub shortens the "working length" of the bristle without changing the overall length. The plate(s) or support guide(s) may be removed as the bristle length shortens (wears from use).

TABLE 1

| Variable | Equation | Unit | Bristle Deflection at Various Brush Lengths | | | | | | |
|---|---|---|---|---|---|---|---|---|---|
| Deflection | (F*L^3)/3*E*I) | mm | 8.18 | 7.24 | 6.37 | 5.58 | 4.85 | 4.19 | 3.59 |
| Force | constant | N | 0.03 | 0.03 | 0.03 | 0.03 | 0.03 | 0.03 | 0.03 |
| Length | variable | mm | 25 | 24 | 23 | 22 | 21 | 20 | 19 |
| Modulus of Elasticity for Nylon | constant | Gpa | 3E+09 | 3E+09 | 3E+09 | 3E+09 | 3E+09 | 3E+09 | 3E+09 |
| Moment of Inertia for Cylinder | (pl/64)*d^4 | mm^4 | 0.006362 | 0.006362 | 0.006362 | 0.006362 | 0.006362 | 0.006362 | 0.006362 |
| Bristle Diameter | constant | mm | 0.6 | 0.6 | 0.6 | 0.6 | 0.6 | 0.6 | 0.6 |

| Variable | Equation | Unit | Bristle Deflection at Various Brush Lengths | | | | | |
|---|---|---|---|---|---|---|---|---|
| Deflection | (F*L^3)/3*E*I) | mm | 3.05 | 2.57 | 2.15 | 1.77 | 1.44 | 1.15 |
| Force | constant | N | 0.03 | 0.03 | 0.03 | 0.03 | 0.03 | 0.03 |
| Length | variable | mm | 18 | 17 | 16 | 15 | 14 | 13 |
| Modulus of Elasticity for Nylon | constant | Gpa | 3E+09 | 3E+09 | 3E+09 | 3E+09 | 3E+09 | 3E+09 |
| Moment of Inertia for Cylinder | (pl/64)*d^4 | mm^4 | 0.006362 | 0.006362 | 0.006362 | 0.006362 | 0.006362 | 0.006362 |
| Bristle Diameter | constant | mm | 0.6 | 0.6 | 0.6 | 0.6 | 0.6 | 0.6 |

There is at least one bristle in a tuft. In most brushes, there are multiple bristles per tuft.

Figure 7:
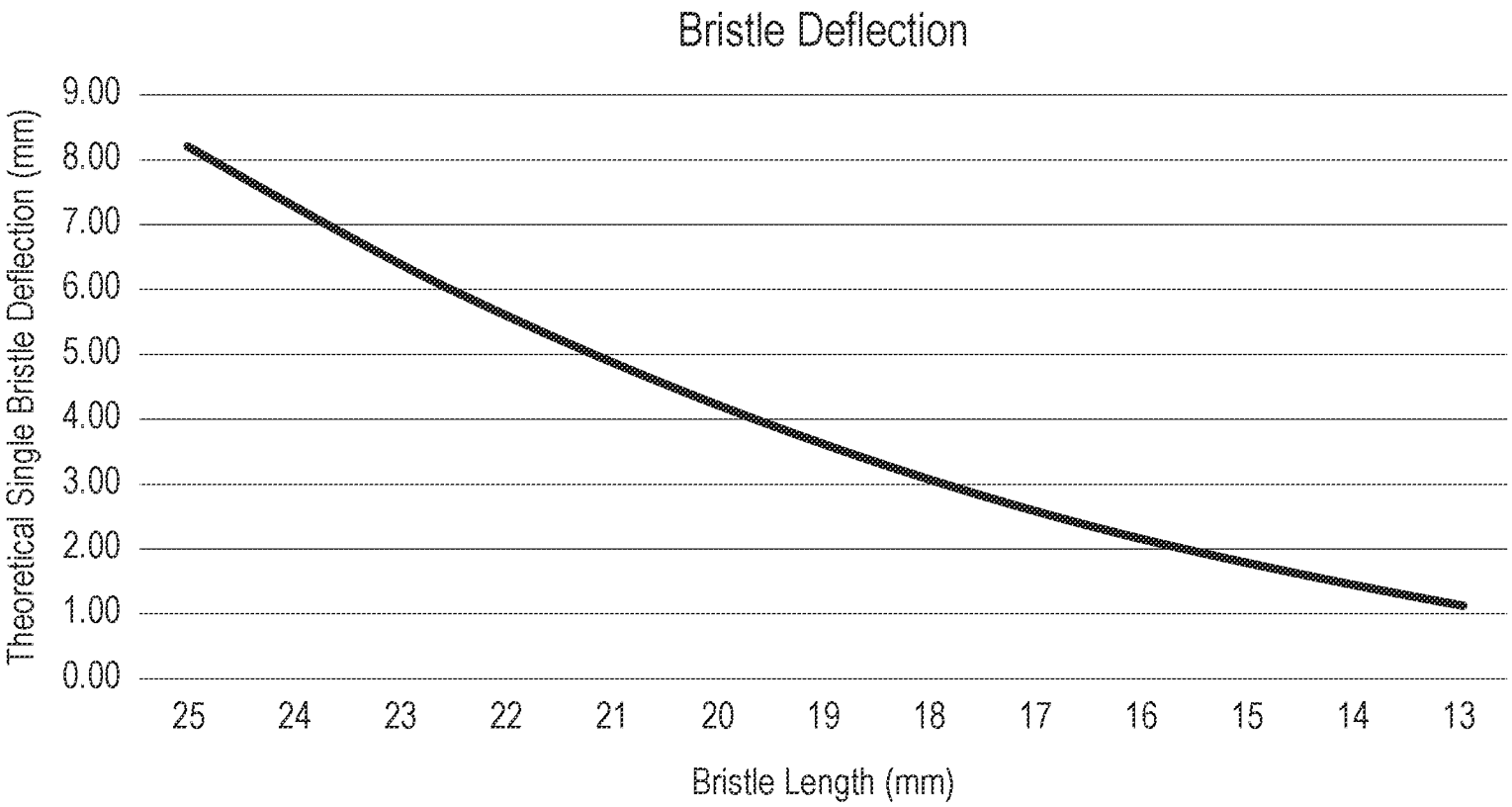
FIG. 7. shows a graph of bristle deflection as bristle length decreases using the removable plates of this invention.

FIG. 7 shows a graph with the data of Table 1. FIG. 7 shows how the bristle deflection decreases as bristle length decreases.

In certain embodiments of this invention, as shown in FIGS. 2A, 2B, and 2C, and FIG. 5, a modified honing brush (10) is provided comprising one or more bristles (14) and one or a plurality of reusable stackable plates (20, 30, and 40-FIGS. 2A, 2B, and 2C) or support guides (50, 52, 54, 56, and 58-FIG. 5) having one or more holes or voids located in said plates or support guides, and wherein each of said bristles (14) is independently fitted through one or more of said holes or voids of said plates or support guides.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

For purposes of the description above, it is to be understood that the invention may assume various alternative variations and step sequences except where expressly specified to the contrary. Moreover, all numbers expressing, for example, quantities of ingredients used in the specification and claims, are to be understood as being modified in all instances by the term "about". Accordingly, unless indicated to the contrary, the numerical parameters set forth are approximations that may vary depending upon the desired properties to be obtained by the present invention. At the very least, and not as an attempt to limit the application of the doctrine of equivalents, each numerical parameter should at least be construed in light of the number of reported significant digits and by applying ordinary rounding techniques.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application, the articles "a", "an", and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A modified honing brush comprising:

a brush hub having a face wherein said face of said brush hub has or a plurality of outwardly projecting bristles, wherein each of said bristles has a shaft having a length; and a first plate having a first side, a middle section, and a second side, wherein said middle section of said first plate is disposed between said first side of said first plate and said second side of said first plate, and wherein said first side of said first plate is opposite to said second side of said first plate, the first side of the first place facing toward the face of the brush hub, the first plate having a plurality of holes or voids extending from said first side of said first plate, through said middle section of said first plate and through said second side of said first plate, a second plate having a first side, a middle section, and a second side, wherein said middle section of said second plate is disposed between said first side of said second plate and said second side of said second plate, and wherein said first side of said second plate is opposite to said second side of said second plate, the second plate being removably stackable onto the first plate so that the first side of the second plate is adjacent the second side of the first plate in a stacked position and the second plate is also removable from the first plate, the second plate having a plurality of holes or voids aligned with the holes or voids of the first plate in the stacked position;

the shafts of the bristles being passed through the holes or voids of the first plate and the holes or voids of the second plate such that removal of the second plate from the first plate exposes a portion of the shafts that are within the holes or voids of the second plate adjacent to the second side of the first plate so a working length of the bristles is increased to account for wear of the bristles that shortens the length of the shaft of each of the bristles.

2. The modified honing brush of claim 1, wherein said middle section of said first plate has a thickness of from about 1 millimeter to about ten millimeters.

3. The modified honing brush of claim 1, wherein said shaft of said bristle is positioned generally perpendicular to said face of said brush hub.

4. The modified honing brush of claim 1, wherein the length of the shaft is from about 5 millimeters to about 30 millimeters.

5. The modified honing brush of claim 1, wherein said bristle is made of an abrasive material or coated with an abrasive material, a non-metallic material, a plastic material, a polyurethane material, or a flexible material.

6. The modified honing brush of claim 1, wherein said bristles are arranged in a homogenous array or arranged in one or more concentric circles, attached and positioned on or partially within said brush hub.

7. The modified honing brush of claim 1, wherein the plurality of bristles are formed in at least one tufted bristle arrangement.

8. The modified honing brush of claim 7, wherein said brush hub has a plurality of tufted bristle arrangements.

9. The modified honing brush of claim 8, wherein each of the tufted bristle arrangements are independently fitted through one or more of said holes or voids of said first plate and one or more of the holes or voids of the second plate.

10. The modified honing brush of claim 1, wherein the first side of the second plate contacts the second side of the first plate when the second plate is in the stacked position.

11. The modified honing brush of claim 1, including a third plate having a first side, a middle section, and a second side, wherein said middle section of said third plate is disposed between said first side of said third plate and said second side of said third plate, and wherein said first side of said third plate is opposite to said second side of said third plate, the third plate being removably stackable onto the second plate so that the first side of the third plate is adjacent to the second side of the second plate in a stacked position and the third plate is also removable from the second plate, the third plate having a plurality of holes or voids aligned with the holes or voids of the second plate in the stacked position;

the shafts of the bristles being passed through the holes or voids of the third plate, the holes or voids of the second plate, and the holes or voids of the first plate such that removal of the third plate from the second plate exposes a portion of the shafts that are within the holes or voids of the third plate adjacent to the second side of the second plate so the working length of the bristles is increased to account for wear of the bristles that shortens the length of the shaft.

12. The modified honing brush of claim 1, wherein said middle section of said second plate has a thickness of from about 1 millimeter to about ten millimeters.

13. The modified honing brush of claim 11, wherein said second plate is independently removable from said first plate and said third plate is independently removable from said second plate.

14. The modified honing brush of claim 13, wherein said working length of the bristles is adjustable to adjust a degree to which the bristles deflect during honing.

15. The modified honing brush of claim 14, wherein said first plate, said second plate, and said third plate are each independently made of a material that is one selected from the group consisting of a metallic material, a non-metallic material, a thermoplastic plastic, a polyurethane polymer, or a flexible material.

16. The modified honing brush of claim 1, wherein the working length of the bristles is adjustable to increase a degree to which the bristles deflect during honing.

17. The modified honing brush of claim 16, wherein the first plate is removable from the brush hub so the working length of the bristles is increased to account for wear of the bristles that shortens the length of the shaft of each of the bristles.

18. A modified honing brush comprising:

a brush hub having a face wherein said face of said brush hub has a plurality of outwardly projecting bristles, wherein each of said bristles has a shaft having a length; and a plurality of support guides, each of said support guides having a shape of a partially complete concentric circle or a complete concentric circle, each of said support guides having a first side, a middle section, and a second side, wherein said middle section of said support guide is disposed between said first side of said support guide and said second side of said support guide, and wherein said first side of said support guide is opposite to said second side of said support guide, and wherein said middle section of said support guide has a top open end and a bottom open end, and wherein said top open end of said support guide is opposite to said bottom open end of said support guide such that a vertical height of the support guide is between about 1 millimeter (mm) to about 10 mm, the vertical height extending in a direction that is perpendicular to the face of the brush hub, and wherein the shafts of the bristles being passed through the support guides such that different ones of the bristles are passed through different middle sections of the support guides, the support guides being removable from the face of the brush hub so a working length of the bristles is adjustable to account for wear of the bristles that shortens the length of the shaft of each of the bristles.

19. The modified honing brush of claim 18, wherein the vertical height that is perpendicular to said face of said brush hub is from 1 mm to less than or equal to 10 mm and wherein the length of the shaft is greater than the vertical height.

20. The modified honing brush of claim 18, wherein said shaft is positioned generally perpendicular to said face of said brush hub.

21. The modified honing brush of claim 18, wherein said shaft has a length from about 5 millimeters to about 30 millimeters.

22. The modified honing brush of claim 18, wherein the bristles are comprised of an abrasive material or coated with an abrasive material, a non-metallic material, a plastic material, a polyurethane material, or a flexible material.

23. The modified honing brush of claim 18, wherein said bristles are arranged in a homogenous array or in one or more concentric circles, positioned on and attached to said brush hub or attached partially within said brush hub.

24. The modified honing brush of claim 18, wherein the plurality of bristles are formed in at least one tufted bristle arrangement.

25. The modified honing brush of claim 24, wherein said brush hub has a plurality of tufted bristle arrangements.

26. The modified honing brush of claim 25, wherein one or more of said tufted bristle arrangements are independently fitted through said middle section of said support guide.

27. A modified honing brush comprising one or more bristles and a plurality of reusable stackable plates positionable in a stack on a brush hub having the one or more bristles such that each of the plates in the stack is independently removeable from the stack so a working length of the bristles is increased to account for wear of the bristles that shortens a length of the bristles.

* * * * *